US005676363A

United States Patent [19]

Kishida et al.

[11] Patent Number: 5,676,363

[45] Date of Patent: Oct. 14, 1997

[54] IMAGE FORMING APPARATUS WITH RECORDING MEDIUM CONVEYANCE CONTROL

[75] Inventors: Tetsuo Kishida, Yokohama; Kenjiro Hori, Tokorozawa; Satoshi Akiyama, Yokohama; Hideki Suzuki, Yokohama; Takefumi Takubo, Yokohama; Nobuyuki Kinoshita, Yamato, all of Japan

[73] Assignee: Canon Kabushiki Kaisha, Tokyo, Japan

[21] Appl. No.: 778,286

[22] Filed: Jan. 2, 1997

Related U.S. Application Data

[63] Continuation of Ser. No. 43,296, Apr. 6, 1993, abandoned.

[30] Foreign Application Priority Data

Apr. 13, 1992 [JP] Japan ..... 4-119671

[51] Int. Cl.[6] ..... B65H 5/00

[52] U.S. Cl. ..... 271/10.01; 271/10.03; 271/10.11; 271/265.01

[58] Field of Search ..... 271/9.06, 10.01, 271/10.03, 10.11, 265.01

[56] References Cited

U.S. PATENT DOCUMENTS

| | | | |
|---|---|---|---|
| 4,780,740 | 10/1988 | Fukae | 271/171 X |
| 4,809,050 | 2/1989 | Ito | 271/9.06 X |
| 4,853,740 | 8/1989 | Ushio et al. . | |
| 4,933,772 | 6/1990 | Ikenoue et al. . | |
| 4,990,941 | 2/1991 | Kawai . | |
| 4,992,882 | 2/1991 | Ikenoue et al. . | |
| 5,028,042 | 7/1991 | Yamada et al. | 271/9.06 |
| 5,105,229 | 4/1992 | Ozaki | 271/9.06 X |
| 5,297,787 | 3/1994 | Shirai | 271/171 |

*Primary Examiner*—David H. Bollinger

*Attorney, Agent, or Firm*—Fitzpatrick, Cella, Harper & Scinto

[57] ABSTRACT

In an image printing operation, advance sheet feeding is performed if the size of a recording medium is known upon feeding at least one sheet of the recording medium. To the contrary, advance sheet feeding is not performed if the size of a recording medium is not known, for example, immediately after a power supply has been turned on or after a new supply of recording medium has been placed in a sheet feeding unit.

33 Claims, 12 Drawing Sheets

FIG.12

<table>
<tr><td>1ST BIT</td><td colspan="2">ERROR BIT : 1 FOR ERROR;<br>0 FOR NORMAL OPERATION</td></tr>
<tr><td>2ND BIT</td><td>BIT5</td><td rowspan="6">SHEET-SIZE CODE IS EXPRESSED BY 6 DIGITS COMORISIN BIT5~BIT0.<br><br>CODE IS EXPRESSED BY HEXADECIMA-NOTATION, WHERE BITS 5 AND 0 CORRESPOND TO MSB AND LSB RESPECTIVELY, FIG.13 SHOWS CONTENTS OF CODE.</td></tr>
<tr><td>3RD BIT</td><td>BIT4</td></tr>
<tr><td>4TH BIT</td><td>BIT3</td></tr>
<tr><td>5TH BIT</td><td>BIT2</td></tr>
<tr><td>6TH BIT</td><td>BIT1</td></tr>
<tr><td>7TH BIT</td><td>BIT0</td></tr>
<tr><td>8TH BIT</td><td colspan="2">ODD-PARITY BIT</td></tr>
</table>

FIG.13

| SHEET-SIZE CODE | SHEET SIZE |
|---|---|
| 01h | A4 LENGTHWISE |
| 04h | LETTER LENGTHWISE |
| 09h | B5 LENGTHWISE |
| 0Ch | LEGAL LENGTHWISE |
| 00h | INDEFINITE |

IMAGE FORMING APPARATUS WITH RECORDING MEDIUM CONVEYANCE CONTROL

This application is a continuation of application No. 08/043,296, filed Apr. 6, 1993, now abandoned.

BACKGROUND OF THE INVENTION

1. Field of the Invention

This invention relates to an image forming apparatus Which performs printing while conveying a recording medium.

2. Description of the Related Art

In order to improve the throughput of a conventional image forming apparatus which performs printing while conveying a recording medium, there is an approach termed "advance sheet feeding" in which before printing of a certain page is terminated, a sheet of the recording medium for the next page is fed to a predetermined position, as described, for example, in U.S. Ser. No. 04/998,770 and U.S. Pat. Nos. 4,933,772, 4,992,882 and 4,990,941. By starting printing for the next page immediately after the completion of printing of the preceding page, the throughput of the apparatus is improved.

In the above-described conventional approach, the size of the recording medium is known in advance, and advance sheet feeding is performed with an appropriate timing corresponding to the size. In this approach, it is necessary to provide dedicated means for detecting only the size of the recording medium in advance, causing an increase the cost of the apparatus.

In general, the size of a recording medium is detected by identifying a sheet-feeding cassette for accommodating sheets of the recording medium. That is, each sheet-feeding cassette is provided with, for example, projections for representing the size of a recording medium to be accommodated therewithin. When such a sheet-feeding cassette is mounted in an image forming apparatus, the projections selectively depresses microswitches or the like provided in the apparatus, whereby the size of the recording medium is detected.

In this approach, however, the size of a recording medium cannot be detected if the recording medium is manually fed as multiple sheets (using an optional feeder), or fed from a universal cassette. In such cases, advance sheet feeding cannot be appropriately performed, and therefore the throughput of the apparatus is not improved.

A description will be now provided of other problems in the related art.

FIG. 5 is a diagram showing the schematic configuration of a conventional image forming apparatus, and illustrates the case of a laser beam printer which utilizes an electrophotographic process.

This apparatus includes photosensitive drum 1, serving as an electrostatic-latent-image bearing member, polygonal scanner 3 for scanning the surface of photosensitive drum 1 with laser beam 2, charger 4 for uniformly charging the surface of photosensitive drum 1, transfer roller 8 for transferring an electrostatic latent image visualized by developer (toner) supplied by toner transfer charger 5 onto recording paper, serving as a recording medium, fixing unit T for fusing a toner image, sheet-feeding roller 8 for feeding a sheet of the recording paper from sheet cassette 9, manual-feeding rollers 10 for feeding a manually fed sheet of the recording paper, registration rollers 11 for synchronizing the timing between sheet conveyance and irradiation of image data onto photosensitive drum 1 using laser beam 2, manually-fed-sheet sensor 12 for detecting the presence of a manually fed sheet, registration sensor 13 for detecting the arrival of a sheet to registration rollers 11, and sheet-discharge sensor 14 for confirming discharge of a sheet from fixing unit 7.

FIG. 6 is a block diagram illustrating the configuration of control circuitry of the image forming apparatus.

In FIG. 6, printer engine control unit 20 controls respective functions within a printer engine in accordance with commands from printer controller 21. Each of the following control units operates in accordance with a command from printer engine control unit 20.

Sheet conveyance control unit 22 controls the drive and stoppage of sheet-feeding roller 8, manual-feeding rollers 10, and registration rollers 11 by the drive and stoppage of motors. Image control unit 23 performs masking processing of an image signal from printer controller 21 to be transmitted to optical system control unit 24 by masking the image signal in accordance with the size of a sheet on which printing is to be performed, so that an image is not developed outside the sheet.

Optical system control unit 24 performs the drive and stoppage of the laser and the scanner. High voltage control unit 25 controls respective high-voltage signals for charging, developing and transfer operations.

Input data control unit 26 transmits signals input from respective sensors to printer engine control unit Next, the operation of printer engine control unit 20 will be described.

FIG. 7 is a flowchart illustrating the operation of printer engine control unit 20.

First, the reception of a print start signal from printer controller 21 is awaited (step S1). Assignment of a sheet-feeding port by printer controller 21 is read (step S2). Then it is determined whether or not manual feeding is being assigned (step S3). If the result of the determination is negative, data for generating an image mask signal corresponding to the sheet size of the cassette is transmitted to image control unit 23 (step S4).

If the result of the determination in step S3 is affirmative, data for generating an image mask signal for the maximum format sheet size which can be printed by the printer (e.g. LEGAL size if B5, A4, LETTER and LEGAL sizes can be fed) is transmitted to image control unit 23 (step S5). Then prerotation for performing warm-up of the drive of the motors and the scanner, high voltage for the photosensitive drum, and the like is started (step S6).

After the completion of the prerotation (step S7), sheet feeding from the assigned sheet-feeding port is started (step S8). When the sheet has reached registration sensor 13 (step S9), a T1-sec timer is set (step S10). After the completion of counting Of the T1-sec timer, sheet-feeding roller 8 is stopped (step S11), and a vertical synchronization request signal is output to printer controller 21 (step S12).

When a vertical synchronizing signal from printer controller 21 has been received (step S13), the drive of registration rollers 11 is started (step S14), and writing of image data onto photosensitive drum 1 is permitted (step S15) to start writing of image data onto photosensitive drum 1. At the same time, a T2-sec timer is set in accordance with the length of the sheet on which printing is to be performed in the direction of sheet conveyance (step S16). After the completion of counting of the T2-timer (step S17), the image writing is inhibited (step S18), and sheet discharging processing is performed (step S19) to terminate the process.

In the above-described approach, however, since means for detecting the size of a sheet to be fed is not provided, it is impossible to limit an image forming region, and therefore an image is formed also outside the image forming region on photosensitive drum 1 corresponding to the size of the fed sheet.

As a result, toner present outside the image forming region is not transferred to the sheet of the recording medium while adhering to the surface of transfer roller 6, causing a stain on the back of the next sheet of the recording medium.

SUMMARY OF THE INVENTION

It is an object of the present invention to improve the throughput of an image forming apparatus.

It is a further object of the present invention to provide an image forming apparatus which can improve its throughput even when multiple sheets are manually fed or sheets are fed from a universal cassette.

It is a still further object of the present invention to provide an image forming apparatus which can improve its throughput using advance sheet feeding without providing dedicated means for detecting only the size of a recording medium.

It is still another object of the present invention to provide an image forming apparatus which can overcome problems in image formation without using dedicated means for detecting the size of a recording medium.

According to one aspect, the present invention which achieves these objectives relates to an image forming apparatus for analyzing input print information and performing printing while conveying a recording medium, comprising a sheet feeding unit which does not include means for detecting the size of a preset recording medium, monitoring means for monitoring a conveyed state of the recording medium, measuring means for measuring the size of the recording medium according to the conveyed state of the recording medium monitored by the monitoring means, and means for controlling the apparatus so as to feed the next sheet of the recording medium with a timing corresponding to the size of the recording medium measured by the measuring means. That is, in this image forming apparatus, advance sheet feeding is performed if the size of a recording medium is known after feeding at least one sheet of the recording medium. To the contrary, advance sheet feeding is not performed if the size of a recording medium is not known, for example, immediately after a power supply has been turned on or the recording medium has been newly set in the sheet feeding unit.

According to another aspect of the present invention, an image forming apparatus for performing image formation by transferring an image from an image bearing member to a recording medium includes a convey device for conveying the recording medium, a detector for detecting a size of the recording medium being conveyed, and a controller for controlling a cleaning operation according to the size of the recording medium detected by the detector as compared to a predetermined size.

According to yet another aspect of the present invention, an image forming apparatus for performing printing while conveying a recording medium includes a sheet feeding unit for conveying the recording medium, a detector provided in the conveying path for the recording medium for detecting a presence of the recording medium and generating an output, a determining device for determining a size of the conveyed recording medium according to the output from the detector, and a notifier for notifying an image processor of the size of the recording medium determined by the determining device.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 12 is a schematic diagram illustrating a sheet-size status in the sixth embodiment; and FIG. 13 is a schematic diagram illustrating a correspondence table between the sheet-size status and the sheet size in the sixth embodiment.

DETAILED DESCRIPTION OF THE PREFERRED EMBODIMENTS

Preferred embodiments of the present invention will now be described with reference to the drawings.

Figure 1:
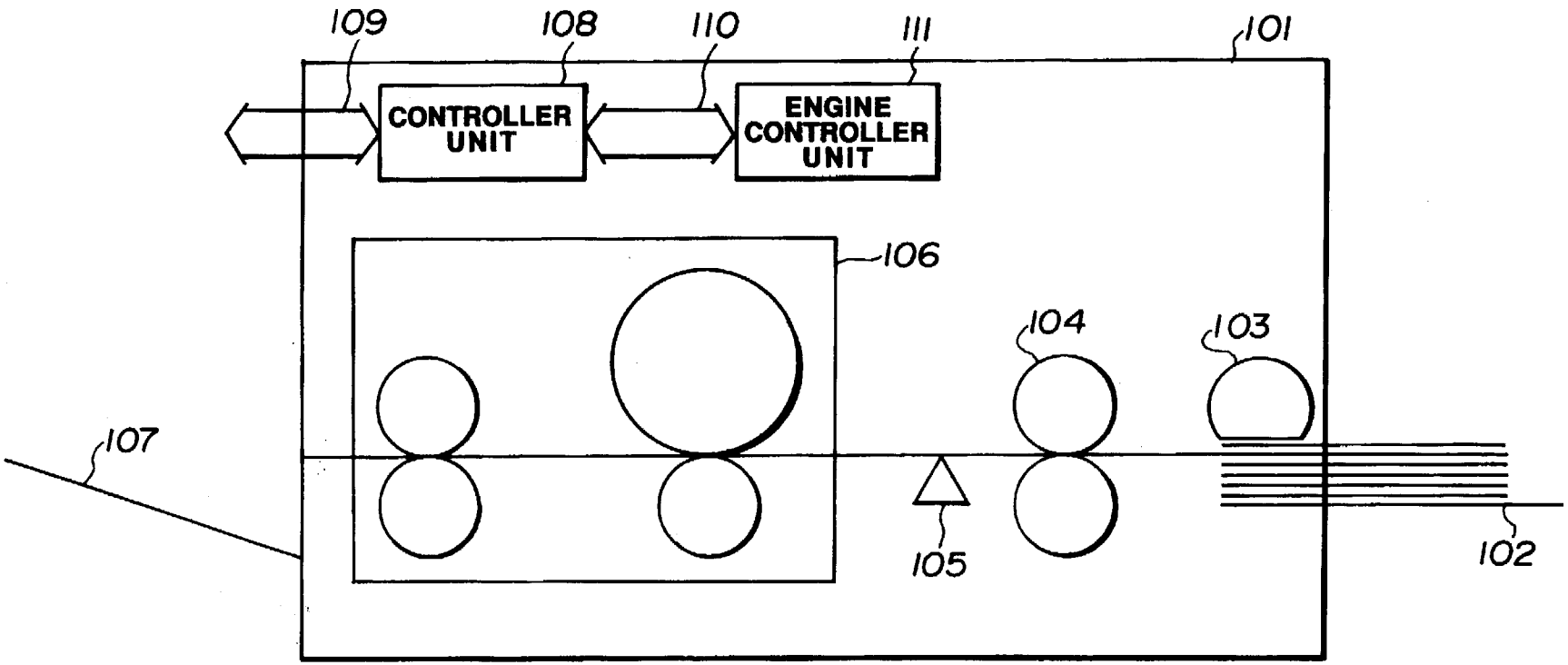
FIG. 1 is a diagram showing the schematic configuration of a first embodiment of the present invention.

FIG. 1 is a diagram showing the schematic configuration of a first embodiment of the present invention.

Laser beam printer 101 in this embodiment includes sheet-feeding tray 102 for accommodating sheets of a recording medium, sheet-feeding roller 103 for individually supplying sheets from within sheet-feeding tray 102, registration rollers 104 for providing a timing for sheet feeding when an image is printed on a sheet, sheet-feeding sensor 105 for detecting whether a sheet is properly fed and conveyed and for determining the size of the sheet, engine unit 106 for performing development, fixing and the like according to an electrophotographic technique, sheet-discharge tray 107 for stocking discharged sheets after printing, and controller unit 108 for receiving encoded image information (code data) from a host computer (not shown) or the like via external interface 109, converting the received information into dot-image video data, and transmitting print commands to engine controller unit 111 via video interface 110.

In the apparatus having the above-described configuration, advance sheet feeding is performed only when the size of a sheet is known, that is, when size information of the fed sheet is stored in a media-information storage area of a memory (not shown). The media-information storage area keeps storing the sheet-size information only while sheets are accommodated within the sheet-feeding tray.

A description will now be provided of the above-described operations in the following two cases.

(1) When printing is performed after turning on the power supply, and thereafter sheets are never removed from the sheet-feeding tray.

(2) A first printing operation after turning on the power supply, a first printing operation when a new supply of sheets has been placed within the sheet-feeding tray after the previous supply of sheets had been exhausted, or a first printing operation when a new supply of sheets has been placed within the sheet-feeding tray after the previous supply of sheets had been removed.

Figure 2:
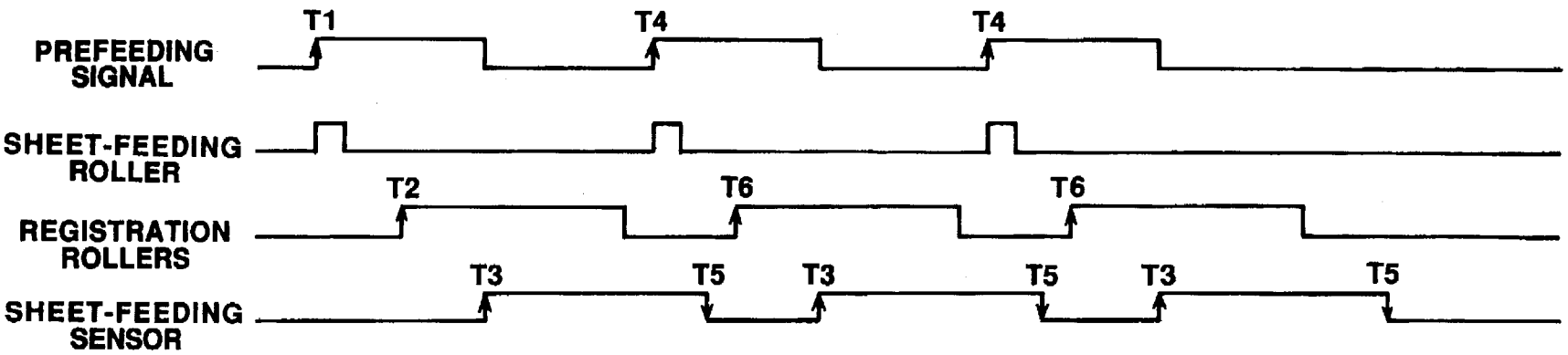
FIGS. 2 and 3 are timing charts illustrating the operations of the first embodiment.

FIG. 2 is a timing chart illustrating the operation in case (1).

In FIG. 2, a prefeeding signal is a signal to instruct advance sheet feeding from controller unit 108 to engine controller unit ill. T1 represents the timing to start sheet feeding instructed by controller unit 108 upon reception of code data in order to perform a printing operation on the first sheet. Sheet-feeding roller 108 is rotated in accordance with the above-described instruction to perform advance sheet feeding.

T2 represents the timing to start to convey the sheet by registration rollers 104 in order to start printing after converting the code data for the first sheet into video data. T3 represents a timing with which the leading end of the sheet passes through sheet-feeding sensor 105. T5 represents the timing when the rear end of the sheet passes through sheet-feeding sensor 105. Accordingly, time (T5–T3) equals the time needed for the sheet to pass through sheet-feeding sensor 105. The size of the sheet (the length in the direction of conveyance) is determined from this value, and the thus determined value is transmitted to controller unit 108 and is stored in the media-information storage area of the memory.

T4 represents the timing to instruct advance sheet feeding of the next sheet. Timing T4 is earlier than timing T5 at which the sheet size is actually known. Since timing T4 can be estimated from the sheet size which has been already known, if the prefeeding signal is output at a predetermined time period before timing T5, that is timing T4, the next sheet does not overlap with the sheet which is currently fed. After sheet feeding sensor 105 has detected the rear end of the current sheet (timing T5), the next sheet already subjected to advance sheet feeding is conveyed to printer engine unit 106 of the printer while providing a time interval necessary to start. printing of the next page (timing T6), that is, while providing a necessary distance between the two sheets.

Figure 3:
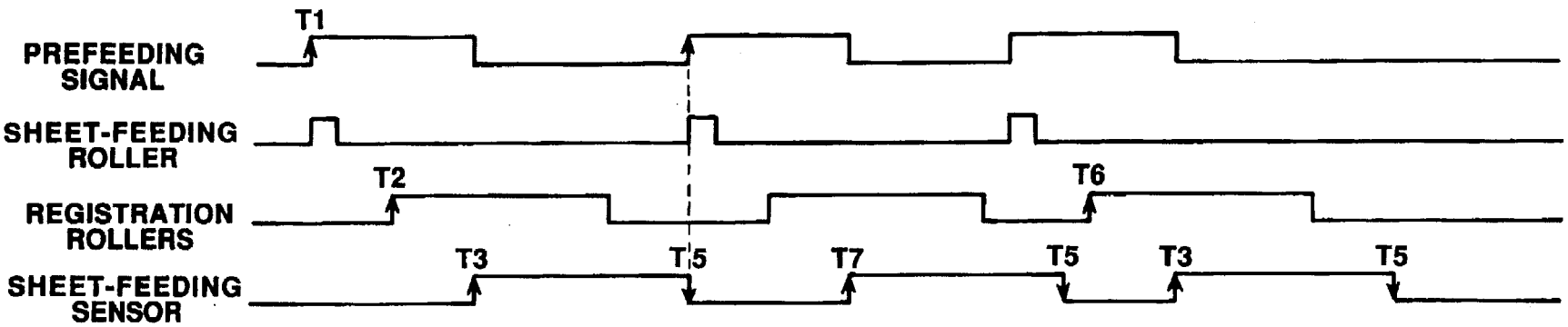

FIG. 3 is a timing chart illustrating the operation in case (2).

This case corresponds to a case in which the first sheet has not yet been printed or the sheet size is not stored in the media-information storage area during a printing operation. In such cases, it is impossible to predict when the rear end of the first sheet passes through sheet-feeding sensor 105. Accordingly, the second sheet cannot be subjected to advance sheet feeding as in the above-described case (1), but is fed within the printer from sheet-feeding tray 102 at the same time as timing T5 of detecting the rear end of the first sheet. Hence, time (T7–T5) between the detection of the rear end of the first sheet and the detection of the leading end of the second sheet which is needed for the present case is longer than time (T3–T5) which is needed for other cases.

As described above, in the present embodiment, since the length of a sheet is measured utilizing a sheet-feeding sensor which is originally provided for detecting the time needed for sheet feeding, and advance sheet feeding is performed based on information obtained from the measurement, it becomes possible to perform advance sheet feeding without newly providing a sensor as in a printer in which sheets are fed from a conventional sheet-feeding tray, and to improve the throughput of the apparatus.

Figure 4:
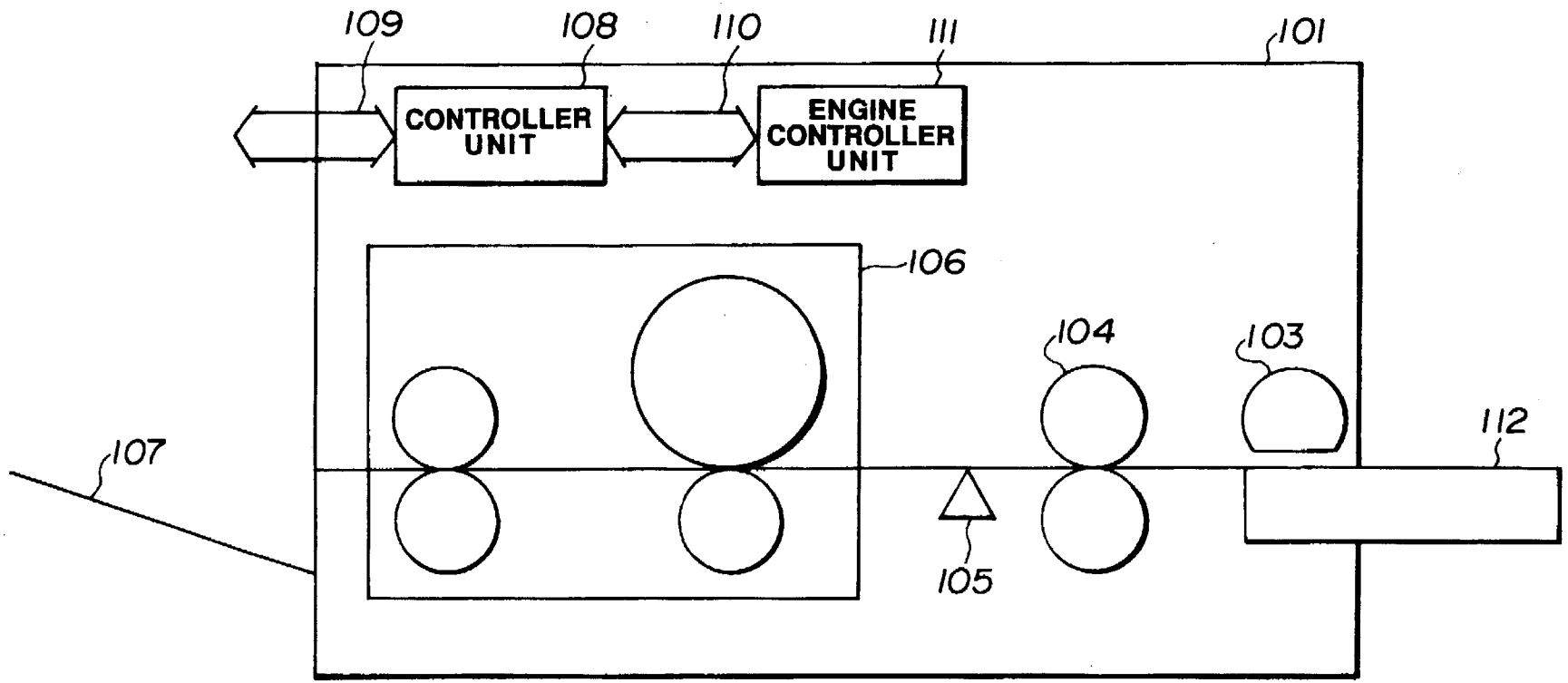
FIG. 4 is a diagram showing the schematic configuration of a second embodiment of the present invention.

FIG. 4 is a diagram showing the schematic configuration of a second embodiment of the present invention.

The second embodiment differs from the first embodiment (shown in FIG. 1) in that sheet cassette 112 is provided in place of sheet-feeding tray 102.

Cassette 112 does not include means, such as a pin or the like, for notifying the printer of the sheet size. That is, as the first embodiment, the second embodiment is configured such that the sheet size cannot be determined before a printing operation. Also in such a configuration, advance sheet feeding can be performed according to entirely the same operation as in the first embodiment.

Next, a third embodiment of the present invention will be described.

In the third embodiment, if a manually fed sheet is smaller than the sheet size assigned by printer controller 21, a longer cleaning sequence is provided upon detecting the small sheet size, whereby toner adhered to transfer roller 6 or the like is removed.

Figure 5:
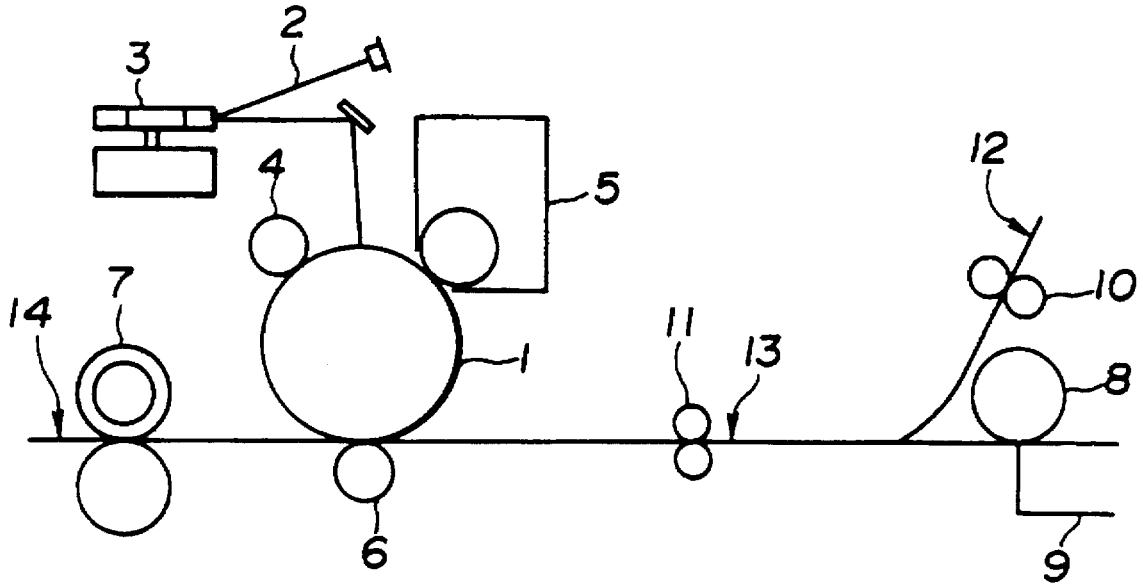
FIG.5 (PRIOR ART)
FIG. 5 is a diagram showing the schematic configuration of a conventional image forming apparatus.
Figure 6:
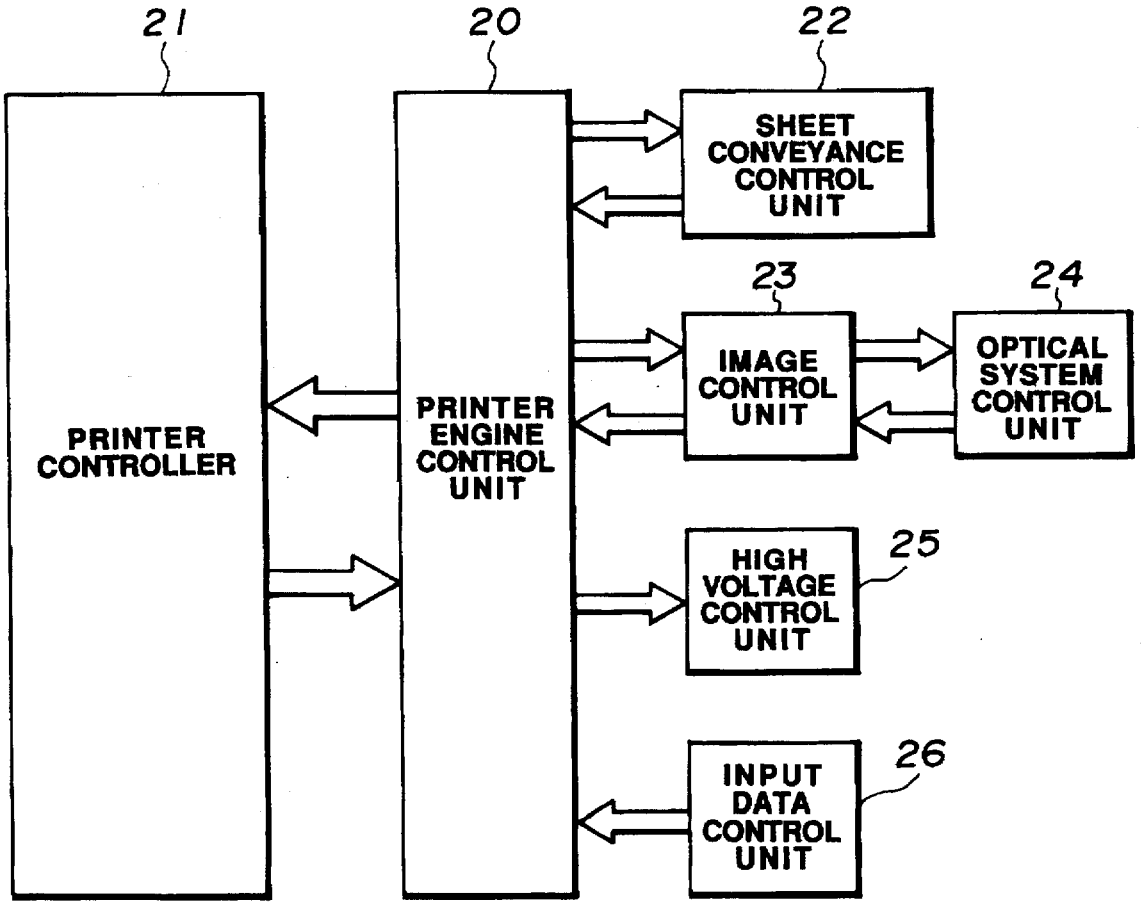
FIG.6 (PRIOR ART)
FIG. 6 is a block diagram illustrating control circuitry of the conventional image forming apparatus.
Figure 7:
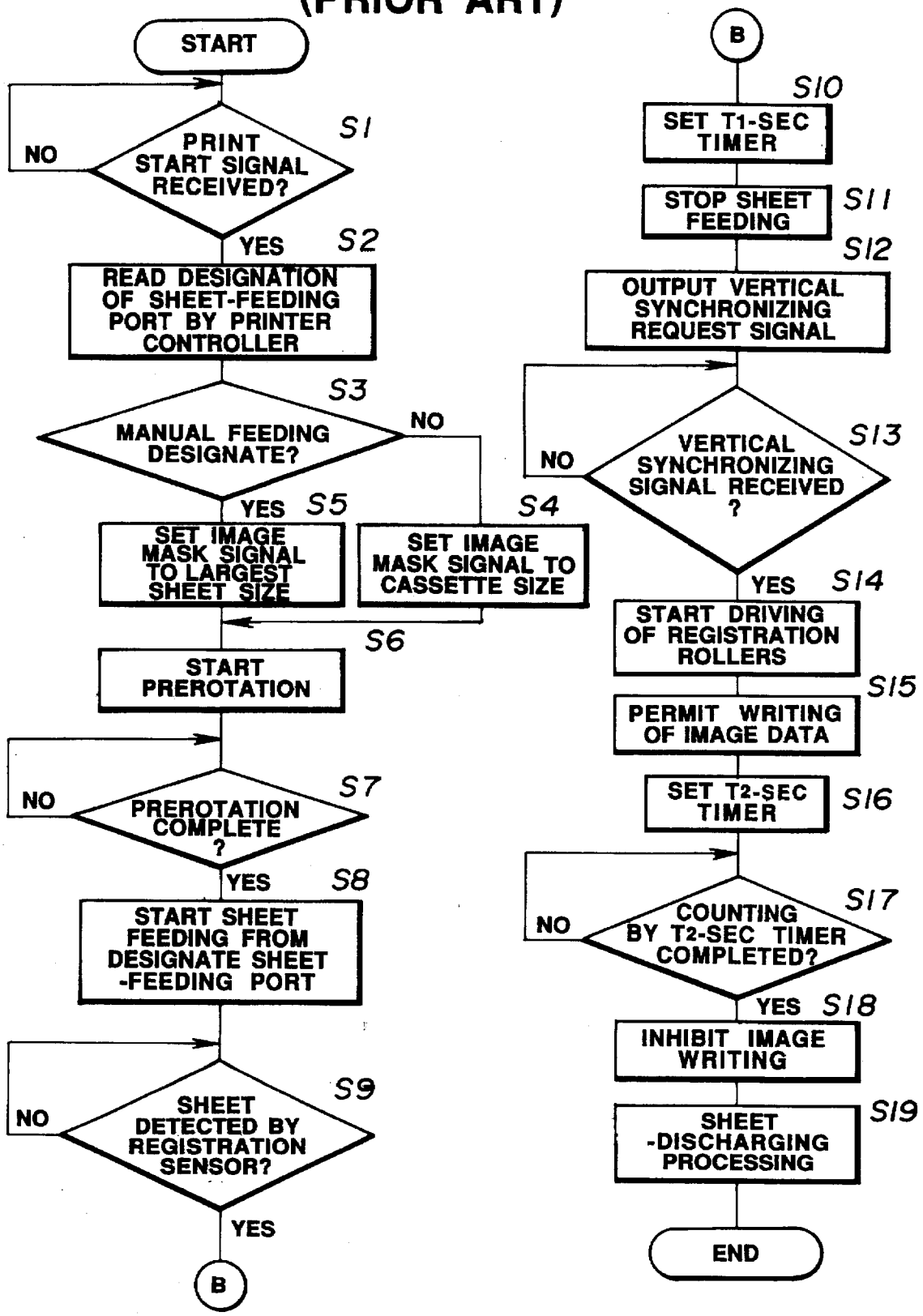
FIG.7 (PRIOR ART)
FIG. 7 is a flowchart illustrating the operation of printer engine control unit 20 of the conventional image forming apparatus.

Since the schematic configuration of the present embodiment is the same as the above-described configuration shown in FIGS. 5 and 6, a description thereof will be omitted.

Figure 8:
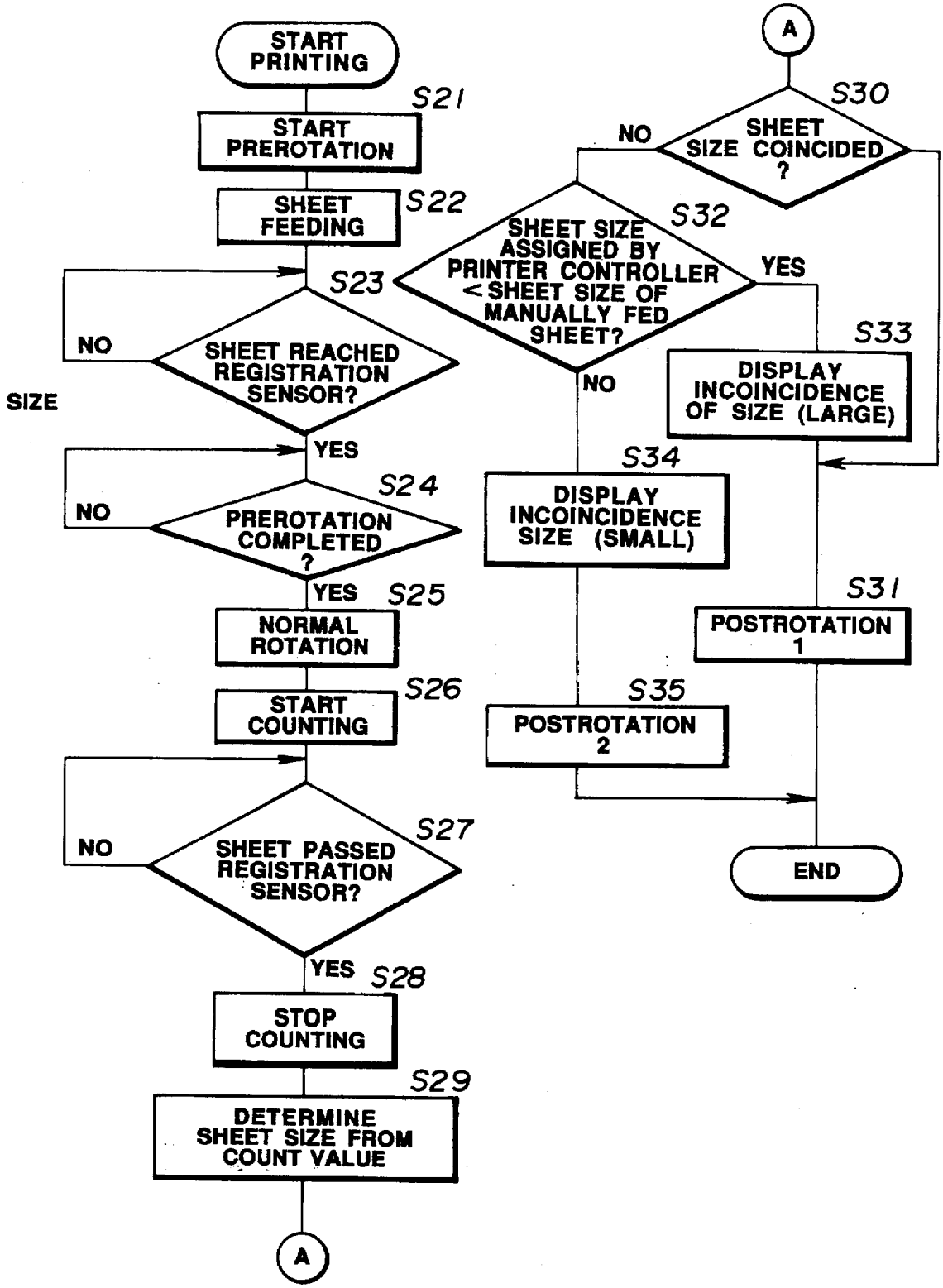
FIG. 8 is a flowchart illustrating the process of a cleaning sequence in manual sheet feeding in a third embodiment of the present invention.

FIG. 8 is a flowchart illustrating the operation of a cleaning sequence in manual sheet feeding in the third embodiment.

Prerotation processing is started (step S21) simultaneously when a printing operation has been started. A sheet of a recording medium is fed from a manual-feeding port (step S22), and reaches registration sensor 12 (step S23). After the completion of prerotation is determined (step 24), the apparatus shifts to normal rotation (step S25). At the same time, counting of the measured time is started (step S26).

When the sheet has passed through registration sensor 13 (step S27), the counting of the measured time is stopped (step S28). Then the measured time of sheet conveyance is compared with the times of conveyance of respective sheet sizes input to printer engine control unit 20 in advance (step S29), and it is determined whether or not the size of the fed sheet coincides with any of the stored sizes (step S30). If the result of the determination is affirmative, postrotation 1 is performed (step S31).

The post rotation 1 corresponds to normal cleaning processing of transfer roller 6. The cleaning processing is processing of returning toner adhered to transfer roller 6 onto the surface of photosensitive drum 1 by reversing a bias voltage for charging transfer roller 6 during the printing operation.

If the result of the determination in step S30 is negative, it is determined whether or not the sheet size issigned by printer controller unit 21 is smaller than the size of the sheet fed from the manual sheet feeding port (step S32). If the result of the determination is affirmative, a display indicating that the size of the fed sheet is large is performed (step S33). In this case, since transfer roller 6 is not stained, only normal cleaning processing is performed (postrotation 1 (step S31)).

If the result of the determination in step S32 is negative, a display indicating that the size of the fed sheet is small is performed (step S34)). In this case, since the size of the sheet fed from the manual Sheet feeding port is smaller than the sheet size assigned by printer controller 21, the image forming region is greater than the size of the fed sheet. Hence, toner particles on an image portion out of the fed sheet adhere to transfer roller 8. Since the toner particles adhering to tranfer roller 6 cannot be completely removed in the normal cleaning sequence (postrotation 1), a cleaning sequence which is longer than the normal cleaing sequence is needed.

Therefore postrotation 2 is then performed (step S35). In postrotation 2, the difference between the time of conveyance of the corresponding sheet size input to printer engine control unit 20 in advance and the measured time of the the fed sheet is obtained, and cleaning processing of transfer roller 6 corresponding to the size of the image portion out of the image forming region is performed, so that no more cleaning than necessary is performed to prevent photosensitive drum 1 from being worn.

In the above-described third embodiment, the cleaning sequence is performed in postrotation. However, in place of performing the cleaning sequence in postrotation, cleaning processing may be performed in prerotation when the next sheet is fed.

Figure 9:
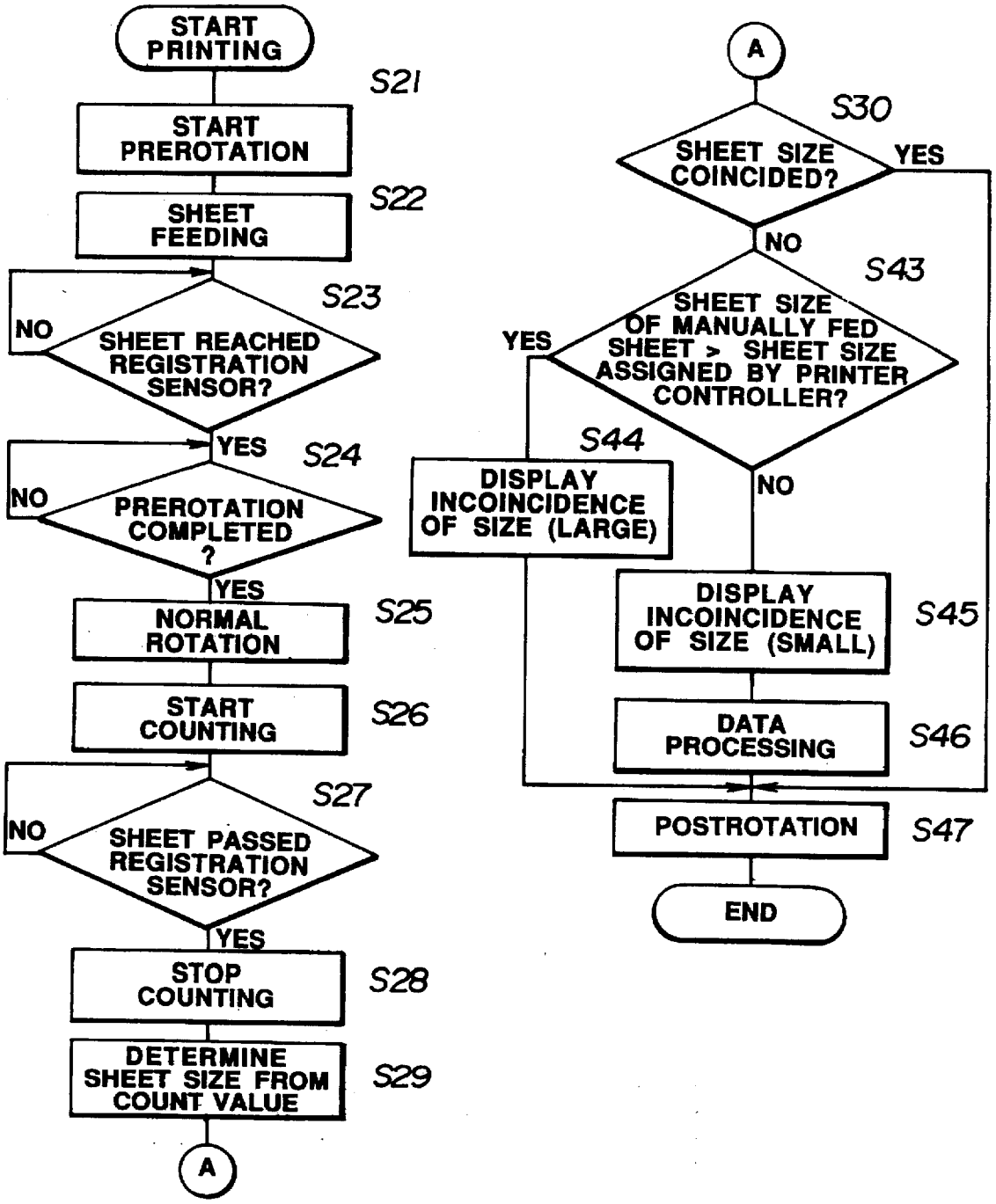
FIG. 9 is a flowchart illustrating the process of a cleaning sequence in manual sheet feeding in a fourth embodiment of the present invention.

FIG. 9 is a flowchart illustrating a fourth embodiment of the present invention which performs such processing.

In FIG. 9, the process in steps S21–S30 is the same as in the third embodiment. If the result of the determination in step S30 is affirmative, postrotation is performed (step S47), and the process is terminated. This postrotation is the same as the postrotation 1 in the third embodiment, and is the normal cleaning sequence.

If the result of the determination in step S30 is negative, it is determined whether or not the size of the sheet fed from the manual sheet feeding port is greater than the sheet size assigned by printer controller 21 (step S43). If the result of the determination is negative, display indicating that the size of the fed sheet is small is performed (step S45), and the difference between two times (the difference between the time of conveyance of the corresponding sheet size input to printer engine control unit 20 in advance and the measured time of the fed sheet) is input to printer engine control unit 20. In addition, the time of cleaning processing corresponding to the input value is set. This processing is data processing (step S46).

When the next sheet is to be printed (step S47), cleaning of transfer roller 8 is performed for the cleaning processing time which has been previously set upon the start of prerotation (step S21). Thus, the back of the fed sheet is not stained.

If the result of the determination in step S43 is affirmative, a display indicating that the size of the sheet is large is effected (step S44). Thereafter, postrotation is performed (step S47), and the process is terminated.

Figure 10:
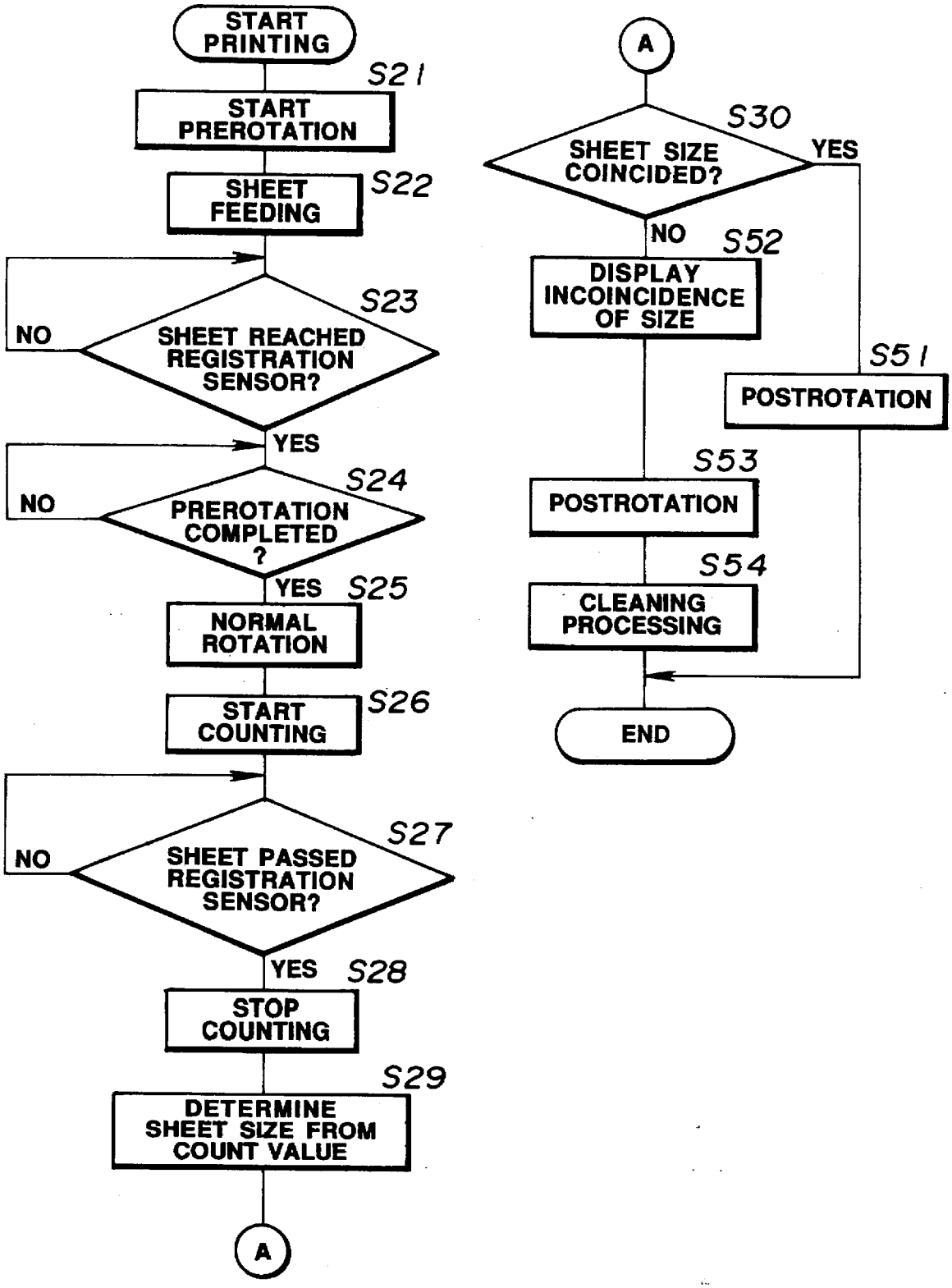
FIG. 10 is a flowchart illustrating the process of a cleaning sequence in manual sheet feeding in a fifth embodiment of the present invention.

Next, a description will be provided of a fifth embodiment of the present invention with reference to the flowchart shown in FIG. 10.

In FIG. 10, the process in steps S21–S30 is the same as in the above-described third embodiment. If the result of the determination in step S30 is affirmative, postrotation is performed (step S51), and the process is terminated. If the result of the determination in step S30 is negative, the incoincidence of the sheet size is displayed using, for example, a light-emitting diode (step S52), and postrotation is performed (step S53). Thereafter the user is urged to supply a cleaning sheet. At that time, a particular cleaning sheet is not required, but a sheet of the same recording medium used in the above-described processes may be used. The size of the cleaning sheet equals the maximum sheet size in manual sheet feeding. The fed cleaning sheet is arranged to be automatically discharged.

Alternatively, a button for instructing cleaning may be provided, and the cleaning sequence may be started by depressing the button.

Next, a sixth embodiment of the present invention will be described.

As in the above-described embodiments, in the apparatus of the sixth embodiment, the size of a fed sheet is detected by a sheet-feeding sensor or a registration sensor, and thereafter printing processing corresponding to the detected size is performed. It is thereby possible to prevent inefficient printing processing in which the maximum size is assumed for a small sheet size even when the size of a sheet is not known in advance, and to shorten the time of printing processing.

Figure 11:
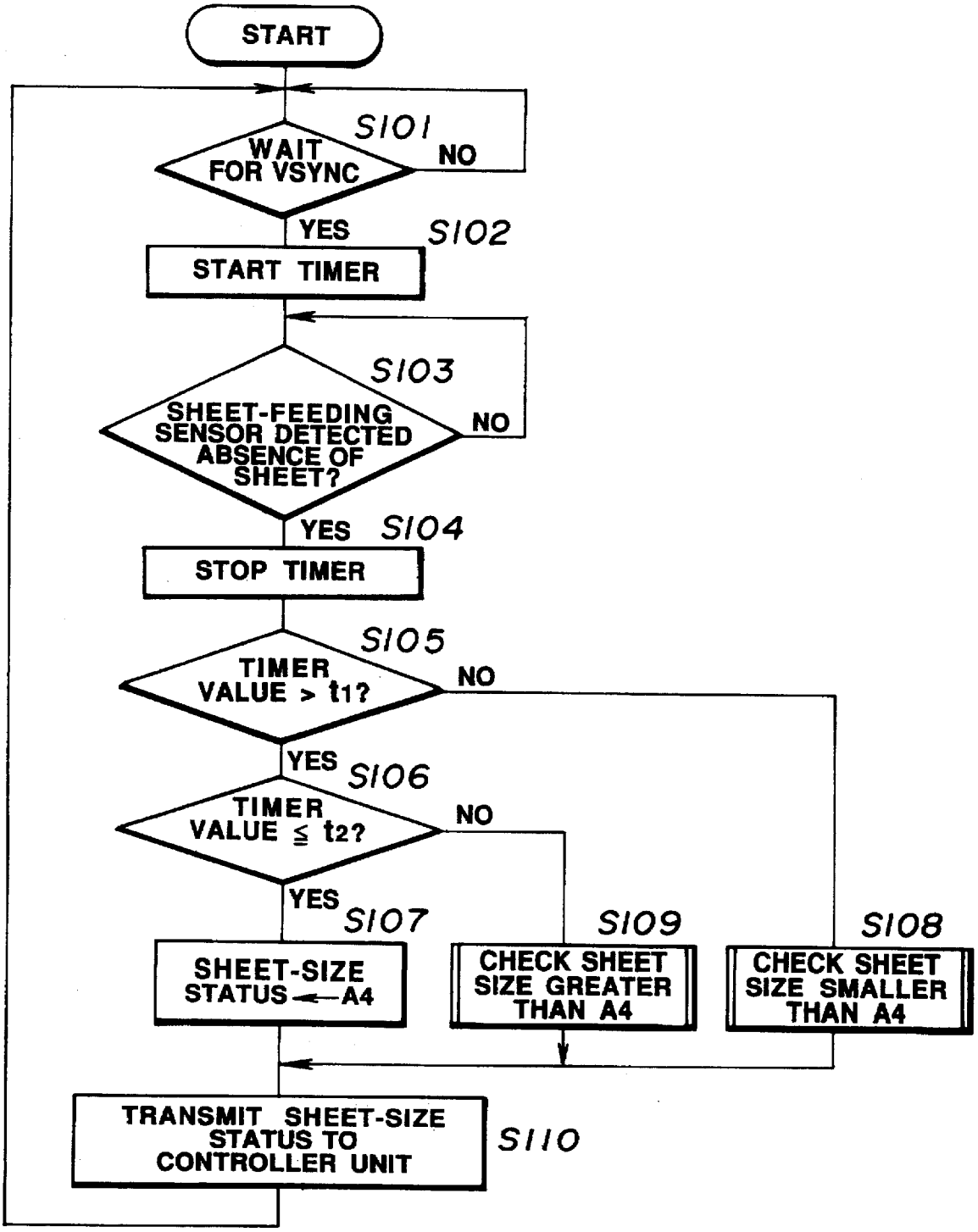
FIG. 11 is a flowchart illustrating a printing operation in a sixth embodiment of the present invention.

FIG. 11 is a flowchart illustrating the operation of the sixth embodiment. The configuration of the apparatus is the same as in the first embodiment (FIG. 1).

In FIG. 11, engine controller unit 111 awaits the transmission of a vertical synchronizing signal (VSYNC) from controller unit 108. When a vertical synchronizing signal has been transmitted (step S101), a timer for measuring the length of a sheet is started (step S102).

Thereafter the state of the sheet-feeding sensor is checked (step S103). When the rear end of the sheet has passed through the sheet-feeding sensor to indicate the state of absence of the sheet, the timer started in step S102 is stopped, and the value of the timer is stored in a memory (step S104).

Thereafter the value of the timer stored in the memory is compared with the minimum conveying time t1 for an A4 sheet (step S105). The minimum conveyihg time t1 is calculated by the following expression:

t1=(the length of the A4 size $-\alpha$)/(conveying speed), where $\alpha$ is a border where the size of a sheet format smaller than the A4 size can be discriminated from the A4 size, for example, half the length obtained by subtracting the length of the LETTER size in the sub-scanning direction from the length of the A4 size.

If the value of the timer is greater than the minimum conveying time t1 in the comparison in step S105, the value of the timer is compared with the maximum conveying time t2 (step S106). The maximum conveying time is calculated by the following expression:

t2=(the length of the A4 size $+\beta$)/conveying speed), where $\beta$ is a border where the size of a sheet format greater than the A4 size can be discriminated from the A4 size, for example, half the length obtained by subtracting the length of the A4 size in the sub-scanning direction from the LEGAL size.

If the value of the timer is smaller than the maximum conveying time t2 in the comparison in step S106, it is determined that the size of the fed sheet is A4, and the code of the A4 size is set in a sheet-size status as shown in FIG. 12 (step S107).

If the value of the timer is smaller than the minimum conveying time t1 in the comparison in step S105, it is determined that the size of the fed sheet is smaller than A4, and the same processing as in steps S105–S107 is performed for the sheet smaller than A4 (step S108).

If the value of the timer is greater than the maximum conveying time t2 in the comparison in step S106, it is determined that the size of the fed sheet is greater than A4, and the same processing as in steps S105–S107 is performed for the sheet greater than A4 (step S109).

The sheet-size status which has been determined in the above-described manner is transmitted to controller unit 108 via video interface 110 to notify the sheet size currently set in the sheet-feeding unit (step S110).

Upon reception of a sheet-size request command from controller unit 108, engine controller unit 111 transmits 8-bit status data as shown in FIG. 12. Controller unit 108 identifies the sheet size by comparing the transmitted sheet-size status with a table shown in FIG. 13.

If the code of the sheet-size status is "00h", controller unit 108 develops image data for the first page in a frame memory (not shown) with the maximum sheet size. Image data for the subsequent pages are developed in the frame memory using the sheet size determined in the above-described processing of identifying the sheet size.

After turning on the power supply, the sheet size status is first set to code "00h" (indefinite), and is determined by the above-described processing of identifying the sheet size. If all sheets are exhausted in the sheet-feeding port after determining the sheet size, the sheet-size status is returned to code "00h" (indefinite), and the sheet size is determined again by the processing of identifying the sheet size.

As described above, since the sheet size is identified using a sheet-feeding sensor for providing synchronization in the sub-scanning direction, it is unnecesary to provide a switch for detecting the sheet size, and the like, and it is thereby possible reduce the production cost.

Although in the sixth embodiment the sheet size is detected by the sheet-feeding sensor, the present invention is not limited to such an approach. For example, a sheet-discharge sensor, or any other sensor, such as a sensor for detecting failure in sheet conveyance, or the like, may also be used.

When the sheet size assigned by a host computer or the like differs from the sheet size of the sheet-size status in a printing operation, a print command for the next page may not be transmitted, a display unit (not shown) may display that sheets must be exchanged, and this state may be held until the code of the sheet-size status becomes "00h".

As described above, according to the present invention, advance sheet feeding is performed if the size of a recording medium is known upon feeding at least one sheet of the recording medium. To the contrary, advance sheet feeding is not performed if the size of a recording medium is not known, for example, immediately after the power supply of the apparatus has been turned on, or a new supply of sheets of a recording medium has been placed in a sheet-feeding unit. As a result, improvement in the throughput of the apparatus caused by advance sheet feeding can be obtained without providing means for detecting the size of a recording medium in advance.

Furthermore, if the size of a fed sheet is smaller than the sheet size assigned by a controller, the fact is detected, and a countermeasure, such as increasing the time period of a cleaning sequence, or the like, is executed. It is thereby possible to remove toner particles in portions outside of an image forming region, and to prevent staining the back of the subsequently supplied sheet.

Moreover, it is possible to detect the size of a fed sheet and to perform development of image data corresponding to the detected size. Hence, even if the sheet size is not known in advance, it is possible to prevent inefficient printing processing in which the maximum size is assumed for a small sheet size, and to shorten the time of printing processing.

The individual components shown in outline or designated by blocks in the drawings are all well-known in the image recording arts and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for performing printing while conveying a recording medium, said apparatus comprising:

a sheet feeding unit for conveying the recording medium;

monitoring means for monitoring conveyance of the recording medium;

measuring means for measuring a size of a first recording medium according to a duration of time of conveyance of the first recording medium as monitored by said monitoring means; and control means for instructing said sheet feeding unit to feed each subsequent sheet of the recording medium at a timing based on the size of the first recording medium as measured by said measuring means.

2. An image forming apparatus according to claim 1, wherein said sheet feeding unit comprises a feeder for feeding a plurality of sizes of recording media.

3. An image forming apparatus according to claim 1, wherein said sheet feeding unit comprises a sheet feeding cassette for accommodating a plurality of recording media.

4. An image forming apparatus according to claim 1, wherein said sheet feeding unit comprises a sheet feeding tray for accommodating a plurality of recording media.

5. An image forming apparatus according to claim 1, wherein said monitoring means comprises means for detecting the presence of the recording medium in a conveying path for the recording medium, and wherein the timing corresponding to the size of the recording medium measured by said measuring means is set before a time of detection of a rear end of an immediately previous sheet of the recording medium by said detection means.

6. An image forming apparatus according to claim 5, wherein prior to measurement of the size of the first recording medium, said control means initiates feeding of the subsequent recording medium in response to the detection of the rear end of the immediately previously fed recording medium by said detection means.

7. An image forming apparatus according to claim 1, wherein said sheet feeding unit stops the recording medium at a predetermined position on a conveying path prior to image formation.

8. An image forming apparatus according to claim 7, further comprising means for converting first information input from an external apparatus into second information.

9. An image forming apparatus according to claim 8, wherein said sheet feeding unit feeds the recording medium to the predetermined position on the conveying path prior to a completion of a conversion by said converting means, and feeds the recording medium from the predetermined position on the conveying path after the completion of the conversion by said converting means.

10. An image forming apparatus according to claim 8, further comprising notifying means for notifying the converting means of the size of the first recording medium measured by said measuring means.

11. An image forming apparatus for forming an image corresponding to image data sent from an image data source onto a recording medium while conveying the recording medium, said apparatus comprising:

a sheet feeding unit for conveying the recording medium;

a detector provided in a conveying path for the recording medium for detecting the recording medium;

determining means for determining a size of the conveyed recording medium according to the output from said detector; and notifying means for notifying said image data source of the size of the recording medium determined by said determining means.

12. An image forming apparatus according to claim 11, further comprising recording means for performing recording according to an electrostatic recording method.

13. An image forming apparatus according to claim 11, wherein said determining means determines a size of a conveyed recording medium by comparing a conveying time of the recording medium determined by using said detector with predetermined time periods associated with standard recording medium sizes.

14. An image forming apparatus having means for setting a plurality of sheets, said apparatus comprising:

a sheet conveying means for conveying a sheet;

detecting means for detecting the sheet during the conveyance;

determining means for determining a size of the sheet in the conveyance direction according to the detection by said detecting means; and control means for controlling a sheet feed timing from said means for setting a plurality of sheets, wherein when a plurality of sheets are continuously fed from said means for setting a plurality of sheets after the size determination by said determining means, said control means controls sheet feed timing from said means for setting a plurality of sheets in accordance with the size determination by said determining means.

15. An image forming apparatus according to claim 14 wherein said means for setting a plurality of sheets can set a plurality of sizes of sheets.

16. An image forming apparatus according to claim 14, wherein said means for setting a plurality of sheets comprises a sheet cassette for accommodating a plurality of sheets.

17. An image forming apparatus according to claim 14, wherein said means for setting a plurality of sheets comprises a sheet feeding tray for accommodating a plurality of sheets.

18. An image forming apparatus according to claim 14, wherein said control means controls the sheet feed timing according to the size determination of the sheet in the conveyance direction, so that a subsequent sheet is fed from said means for setting a plurality of sheets prior to a detection timing of a rear end of an immediately previous sheet by said detection means.

19. An image forming apparatus according to claim 14, wherein said control means controls a sheet feed timing of the subsequent sheet in response to a detection of a rear end of an immediately previous sheet by said detection means until said determining means determines the size of a sheet fed from said means for setting a plurality of sheets in the conveyance direction.

20. An image forming apparatus according to claim 14, wherein said sheet conveying means stops the sheet fed from said means for setting a plurality of sheets at a predetermined position on a conveying path prior to an image formation.

21. An image forming apparatus according to claim 20, further comprising means for converting first information input from an external apparatus into second information.

22. An image forming apparatus according to claim 21, wherein said sheet conveying means feeds the sheet to the predetermined position on the conveying path prior to a completion of a conversion by said converting means, and feeds the sheet from the predetermined position on the conveying path after the completion of the conversion by said converting means.

23. An image forming apparatus according to claim 21, further comprising notifying means for notifying the converting means of the size of the sheet determined by said determining means.

24. A method for controlling an image forming apparatus having means for setting a plurality of sheets, comprising the steps of:

conveying a sheet;

detecting the sheet during a conveyance;

determining a size of the sheet in the conveyance direction according to the detection in said detecting step; and controlling a sheet feed timing from said means capable of setting a plurality of sheets, wherein when a plurality of sheets are continuously fed from said means for setting a plurality of sheets after determination in said determining step, in said control step, the sheet feed timing from said means for setting a plurality of sheets is controlled according to a size of a sheet determined in said determining step.

25. A method according to claim 24, wherein said means for setting a plurality of sheets can set a plurality of sizes of sheets.

26. A method according to claim 24, wherein said means for setting a plurality of sheets comprises a sheet cassette for accommodating a plurality of sheets.

27. A method according to claim 24, wherein said means for setting a plurality of sheets comprises a sheet feeding tray for accommodating a plurality of sheets.

28. A method according to claim 24, wherein in said controlling step, the sheet feed timing is controlled according to the determined size of the sheet in the conveyance direction, so that a subsequent sheet is fed from said means for setting a plurality of sheets prior to a detection timing of a rear end of an immediately previous sheet.

29. A method according to claim 24, further comprising a step of controlling a sheet feed timing of the subsequent sheet in response to a detection of a rear end of an immediately previous sheet until the size of a sheet fed from said means for setting a plurality of sheets in the conveyance direction is determined in said determining step.

30. A method according to claim 24, further comprising a step of stopping the sheet fed from said means for setting a plurality of sheets at a predetermined position on a conveying path prior to an image formation.

31. A method according to claim 30, further comprising a step of converting first information input from an external apparatus into second information.

32. A method according to claim 31, wherein in the sheet conveying step, the sheet is conveyed to the predetermined position on the conveying path prior to a completion of a conversion in said converting step, and wherein said method further comprises a step of feeding the sheet from the predetermined position on the conveying path after the completion of the conversion in said converting step.

33. A method according to claim 30, further comprising a step of notifying the converting means of the size of the sheet determined in said determining step.

* * * * *

UNITED STATES PATENT AND TRADEMARK OFFICE

CERTIFICATE OF CORRECTION

PATENT NO. : 5,676,363
DATED : October 14, 1997
INVENTOR(S) : Tetsuo KISHIDA, et al.

It is certified that error appears in the above-identified patent and that said Letters Patent is hereby corrected as shown below:

Column 1, line 11, delete "Which" and insert therefor --which--;
Line 31, after "increase", insert --in--.

Column 2, line 30, after "unit", insert --20.--;
Line 56, delete "Of" and insert therefor --of--.

Column 5, line 25, delete "ill" and insert therefor --111--;
Line 54, after "start", delete the period (".").

Column 6, line 67, delete "issigned" and insert therefor --assigned--.

Column 7, line 8, after "S34)", delete ")";
Line 9, delete "Sheet" and insert therefor --sheet--.

Column 9, line 38, after "possible", insert --to--.

Signed and Sealed this
Twelfth Day of May, 1998

Bruce Lehman

*Attest:*

BRUCE LEHMAN

*Attesting Officer*

*Commissioner of Patents and Trademarks*